US008885868B2

(12) United States Patent
Davidson et al.

(10) Patent No.: US 8,885,868 B2
(45) Date of Patent: Nov. 11, 2014

(54) LOUDSPEAKER

(75) Inventors: Julia Davidson, Maidstone (GB); Jack Anthony Oclee-Brown, Tonbridge (GB)

(73) Assignee: GP Acoustics (UK) Limited, Maidstone, Kent (GB)

( * ) Notice: Subject to any disclaimer, the term of this patent is extended or adjusted under 35 U.S.C. 154(b) by 0 days.

(21) Appl. No.: 13/696,742

(22) PCT Filed: May 18, 2011

(86) PCT No.: PCT/GB2011/000751

§ 371 (c)(1),
(2), (4) Date: Nov. 7, 2012

(87) PCT Pub. No.: WO2011/144893

PCT Pub. Date: Nov. 24, 2011

(65) Prior Publication Data

US 2013/0058521 A1 Mar. 7, 2013

(30) Foreign Application Priority Data

May 19, 2010 (GB) ..... 1008299.8

(51) Int. Cl.

| | |
|---|---|
| ***H04R 7/24*** | (2006.01) |
| ***H04R 7/18*** | (2006.01) |
| ***H04R 7/26*** | (2006.01) |
| ***H04R 9/04*** | (2006.01) |

(52) U.S. Cl.

CPC .. *H04R 7/18* (2013.01); *H04R 7/26* (2013.01); *H04R 9/043* (2013.01); *H04R 2307/201* (2013.01)

USPC ..... 381/404; 381/398; 381/403; 181/166; 181/171

(58) Field of Classification Search

CPC ..... H04R 7/16; H04R 7/24; H04R 7/26; H04R 9/041; H04R 9/043; H04R 2307/201; H04R 2307/207; H04R 2400/07

USPC ..... 381/398, 403, 404; 181/166, 171, 172

See application file for complete search history.

(56) References Cited

U.S. PATENT DOCUMENTS 3,125,647 A * 3/1964 Rouy ..... 381/432
4,056,697 A * 11/1977 Heil ..... 381/408

(Continued)

FOREIGN PATENT DOCUMENTS

DE 9109452 U1 10/1991
EP 1860912 A1 11/2007

(Continued)

OTHER PUBLICATIONS

GB Search Report: GB1008299.8 (Jul. 20, 2010).

(Continued)

*Primary Examiner* — Curtis Kuntz
*Assistant Examiner* — Joshua A Kaufman
(74) *Attorney, Agent, or Firm* — Westman Champlin & Koehler, P.A.; Z. Peter Sawicki; Amanda Prose

(57) ABSTRACT

A loudspeaker is disclosed, comprising a driven body and a suspension for providing a restoring force to the driven body, the suspension having a cup geometry wherein its attachment point on the fixed portion of the loudspeaker is displaced along the axis of motion relative to its attachment point on the driven body and comprising a first concentric region that is extendible to allow reciprocating axial movement of the driven body, a second concentric region which extends transversely from the first region toward one of the attachment points, and a circumferential member affixed to the suspension at a location between the first and second concentric regions, the circumferential member being relatively stiff compared to the material forming the first and second concentric regions.

20 Claims, 3 Drawing Sheets

(56) References Cited

U.S. PATENT DOCUMENTS

| | | | | |
|---|---|---|---|---|
| 5,619,019 | A | 4/1997 | Yoshimura et al. | |
| 5,734,132 | A * | 3/1998 | Proni | 181/171 |
| 6,351,544 | B1 * | 2/2002 | Noll | 381/404 |
| 6,385,327 | B1 * | 5/2002 | D'Hoogh | 381/398 |
| 6,449,375 | B1 * | 9/2002 | Hutt | 381/403 |
| 6,567,528 | B1 * | 5/2003 | Heed | 381/404 |
| 6,735,323 | B1 | 5/2004 | Chang | |
| 7,542,583 | B2 * | 6/2009 | Funahashi | 381/398 |
| 7,822,222 | B2 * | 10/2010 | Funahashi | 381/423 |
| 8,094,862 | B2 * | 1/2012 | Funahashi | 381/398 |
| 8,111,868 | B2 * | 2/2012 | Kaiya | 381/403 |
| 2003/0068064 | A1 | 4/2003 | Czerwinski | |
| 2003/0079936 | A1 | 5/2003 | Kuze et al. | |
| 2007/0071275 | A1 | 3/2007 | Matsuda et al. | |
| 2007/0154058 | A1 | 7/2007 | Ohara | |
| 2007/0154059 | A1 | 7/2007 | Ohara | |
| 2013/0070953 | A1 * | 3/2013 | Dodd et al. | 381/398 |

FOREIGN PATENT DOCUMENTS

| | | | |
|---|---|---|---|
| JP | 60192498 | A | 3/1984 |
| JP | 2007325093 | A | 12/2007 |

OTHER PUBLICATIONS

PCT International Search Report: PCT/GB2011/000751 (Aug. 23, 2001).
PCT Written Opinion: PCT/GB2011/000751 (Aug. 23, 2011).

* cited by examiner

LOUDSPEAKER

CROSS-REFERENCE TO RELATED APPLICATION

This Application is a Section 371 National Stage Application of International Application No. PCT/GB2011/000751, filed May 18, 2011 and published as WO/2011/144893 on Nov. 24, 2011, in English, which claims priority of Great Britain Application No. 1008299.8, filed May 19, 2010, the contents of which are hereby incorporated by reference in their entirety.

FIELD OF THE INVENTION

The present invention relates to the field of loudspeakers and particularly relates to suspensions, also known as spiders or dampers, and loudspeakers comprising them.

BACKGROUND ART

The suspension is a component on a conventional cone driver. It is also known as the spider or damper. Cone drivers are widely used, particularly for the low (20-500 Hz) and midrange (500-3000 Hz) parts of the audio spectrum.

The suspension is typically used in conjunction with the surround—a flexible air seal between the cone and chassis. Together these centre the voice coil in the magnet gap, maintain axial travel, and provide a restoring force on the moving parts. Usually the suspension provides the greater portion of this restoring force. Over small excursions this force is fairly linear and influences the resonant frequency of the drive unit. Over larger excursions its behaviour is non-linear and may be characterised by a stiffness-displacement 'K(x)' curve. To avoid excessive displacement where moving parts collide with the chassis or magnet assembly, stiffness must increase for both positive and negative displacement. If the stiffness-displacement curve is not symmetrical about zero displacement the restoring force provided will not be equal for forwards and backwards motion and the voice coil will oscillate about a position that is offset from the centre of the magnet gap. At higher excursions much of the coil may be away from the cooling effect of the iron poles and may fail due to overheating. A smooth symmetrical increase of stiffness with displacement reduces excessive excursions to minimise the distortion caused by motor nonlinearities.

The suspension is commonly an annular band attached to the voice coil former on its inner edge and the driver chassis on its outer edge. Its structure is often a series of concentric corrugations or 'rolls' of material. The number, size, and shape of the rolls greatly affect the stiffness-displacement curve.

The suspension is typically manufactured from a woven fabric impregnated with resin and moulded into shape. The material needs to be flexible and have some damping properties to minimise resonance in the working bandwidth. It will ideally be porous to avoid radiation of the resonance.

If the inner and outer edges attach at similar heights in the driver assembly the overall form of the suspension will be planar. In that case, the concentric rolls may be designed to provide a symmetrical stiffness-displacement curve.

In certain driver designs the inner and outer edges are not attached at similar heights, however. For instance, for manufacturing reasons the mounting surface on the chassis may not be located at the same height as the mounting position on the voice coil former. Most commonly the corrugated part of the suspension would be aligned to the most appropriate position on the voice coil former and the inner edge mounted there. The outer edge would protrude backwards to meet its mounting surface on the chassis.

An alternative example is a driver in which the suspension attaches to the diaphragm rather than the voice coil former to minimise overall build height. The corrugated part of the suspension is then aligned with the chassis mounting surface and the outer edge mounts there. The inner edge protrudes forward with a generally frusto-conical geometry to mount on the rear of the diaphragm. With this arrangement the rolls will not hit the diaphragm as it moves.

It would also be possible for both edges to protrude or have a shift in height within the corrugated part of the suspension.

These non-planar arrangements are sometimes described as cupped suspensions, where the protrusion is the 'cup'. Such an arrangement may be employed for any number of design reasons.

The problem with a cupped suspension is that the cup can bend more easily in compression than it can stretch in extension. As a result the stiffness-displacement curve is asymmetric, with the restoring force much lower as the diaphragm moves in the direction of the protruding cup. As mentioned above this is an undesirable characteristic.

SUMMARY OF THE INVENTION

This invention relates to a method of reinforcing a cupped suspension to control bending of the cup and thus obtain a symmetrical stiffness-displacement curve, reducing distortion and increasing power handling. The invention also helps prevent catastrophic suspension collapse further improving power handling.

A suspension manufactured using conventional techniques is reinforced with a circular loop. This may be located near the point that a cup meets the corrugated part of the suspension. It may be fixed in a specially designed groove, or to the cup, or to the main part. It may be on either side of the suspension, and may be fixed by a suitable adhesive. The loop might be made from metal or plastic. Where the cup is fixed to the moving parts it may be advantageous to use a loop of low mass to minimise additional moving mass, and to avoid resonances of the loop on the suspension.

The loop should provide greater stiffness than the suspension material to control cup bending. This may be to prevent bending completely in the excursion range of the driver, or limit it by a sufficient amount. The suspension and loop will generally be designed in conjunction to achieve the desired stiffness-displacement curve.

In some cases additional loops may be used to further control bending. An example is a second loop attached part way up a deep cup. Again, the suspension and loops should ideally be designed in conjunction.

Thus, the present invention provides a loudspeaker comprising a driven body responsive to electrical signals to undergo excursions from a rest position along an axis of motion, to project acoustic waves from a front of the loudspeaker, and a suspension for providing a restoring force to the driven body towards the rest position, the suspension extending from an attachment point on the driven body to an attachment point on a fixed portion of the loudspeaker, wherein the attachment point on the fixed portion of the loudspeaker is displaced along the axis of motion relative to the attachment point on the driven body when the driven body is at rest, the suspension comprising a first concentric region of the suspension that is extendible to allow reciprocating axial movement of the driven body, a second concentric region which extends transversely from the first region toward one of the attachment points, and a circumferential member affixed to the suspension at a location between the first and second concentric regions, the circumferential member being relatively stiff compared to the material forming the first and second concentric regions.

The reinforcement solves the asymmetric stiffness-displacement curve problem as the loop controls bending of the cup. The extra stiffness from the loop helps avoid collapse of the cup at high power levels. This allows use of cupped suspensions whilst maintaining control over excursion and power handling, and minimising distortion.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
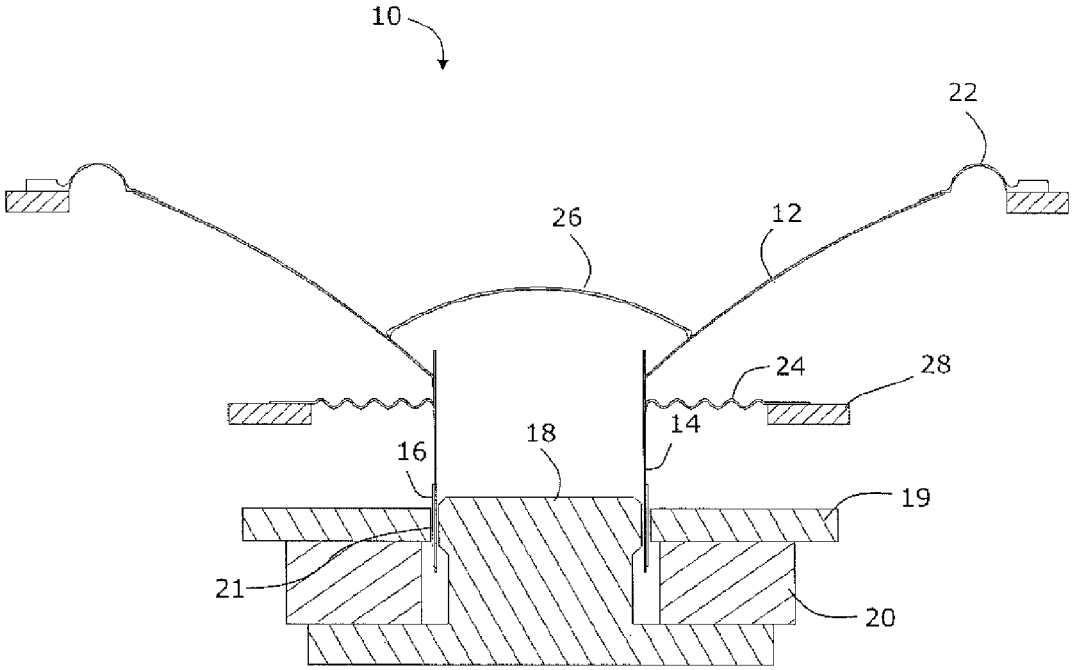
FIG. 1 shows an axial cross-section through a known loudspeaker arrangement having a planar suspension.

FIG. 1 is a cross-sectional view of a conventional loudspeaker 10.

The loudspeaker 10 comprises a diaphragm 12, shaped generally in a frusta-conical form. In operation, the diaphragm 12 is driven forwards and backwards to project acoustic pressure waves from the loudspeaker 10. A surround 22 provides a flexible air seal between the diaphragm 12 and the chassis (not illustrated). The diaphragm 12 extends downwards to connect to a voice coil former 14, around which is wound a coil of conducting material 16 (i.e. a wire), known as the voice coil.

A motor system of the loudspeaker 10 comprises an inner magnetic pole piece 18, a magnet 20, and an outer pole piece 19 displaced from the inner pole piece 18 to form a magnetic gap 21. The voice coil 16 is positioned in the gap 21, such that electrical currents in the coil result in a force that is transferred to the diaphragm 12.

As described above, the loudspeaker 10 is further provided with a suspension 24 between the voice coil former 14 and a fixed point 28 on the chassis (not illustrated). The suspension 24 comprises a first (inner) edge, for attachment to the moving parts of the loudspeaker 10, and a second (outer) edge for attachment to a fixed part of the loudspeaker 10. In between those two edges is a flexible region, capable of limited expansion and contraction as the diaphragm 12 is driven. The flexible region can be constructed from one or more corrugations or rolls of material, as illustrated.

Together with the surround 22, the suspension centres the voice coil in the magnet gap, maintains axial travel, and provides a restoring force on the moving parts (i.e. the voice coil 16, voice coil former 14 and the diaphragm 12). In the illustrated arrangement, the suspension 24 is attached at its inner edge to the voice coil former 14, and at its outer edge to a mounting surface 28 on the chassis. Both of these attachments are at the same height within the loudspeaker 10 (i.e. the same distance from the front of the loudspeaker 10), leading to a generally planar form for the suspension. In this orientation, the suspension is capable of providing a symmetrical stiffness-displacement curve and thus a restoring force to the moving parts of the loudspeaker that is symmetrical about the rest position.

Figure 2:
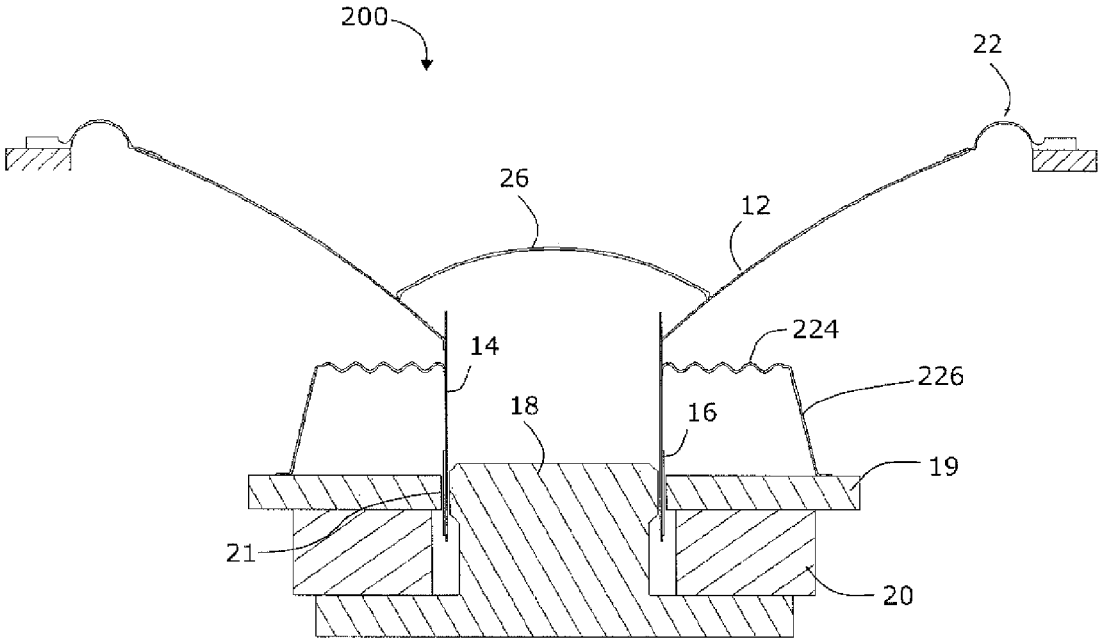
FIG. 2 shows an axial cross-section through a known loudspeaker arrangement having a cupped suspension

FIG. 2 shows a further loudspeaker 200, wherein the suspension is connected differently due to the absence or unavailability of a suitable mounting position 28 on the chassis. The loudspeaker 200 is similar to that described with respect to FIG. 1 and therefore will not be described in great detail. Similar features have been numbered consistently in the figures.

Again, the suspension 224 is connected between the moving parts of the loudspeaker and a stationary part, in order to provide a restoring force. The inner edge of the suspension is attached to the voice coil former 14 as before. However, the outer edge is mounted on the outer pole piece 19, positioned further from the front of the loudspeaker than the inner edge. This results in a non-planar or "cupped" suspension 224, made up of at least one section 226 which protrudes relative to the corrugated part of the suspension. This protrusion generally has a frusto-conical geometry. Such an arrangement may be employed for any number of design reasons.

However, in this orientation, it is easier to displace the inner edge of the suspension 224 backwards than forwards as the protruding section may bend, but without rolls requires greater force to stretch. Thus, the stiffness-displacement curve will be asymmetric and the restoring force provided by the suspension for backward travel of the diaphragm 12 less than that for forward travel of the diaphragm.

The cupped suspension orientation also occurs in other designs, where the central flexible region of the suspension is at a different height (i.e. at a different distance from the front of the loudspeaker) to one or both of the suspension edges. For example, the inner edge may be connected to the diaphragm 12 (or to ribs extending backwards from the diaphragm) and thus be at a greater height (closer to the front of the loudspeaker) than the central flexible region. In another example, the flexible region of the suspension may be at a different height to both of the edges, either above or below the level at which they are attached to the moving or stationary parts of the loudspeaker. In all of these designs, the suspension is non-planar.

Figure 3:
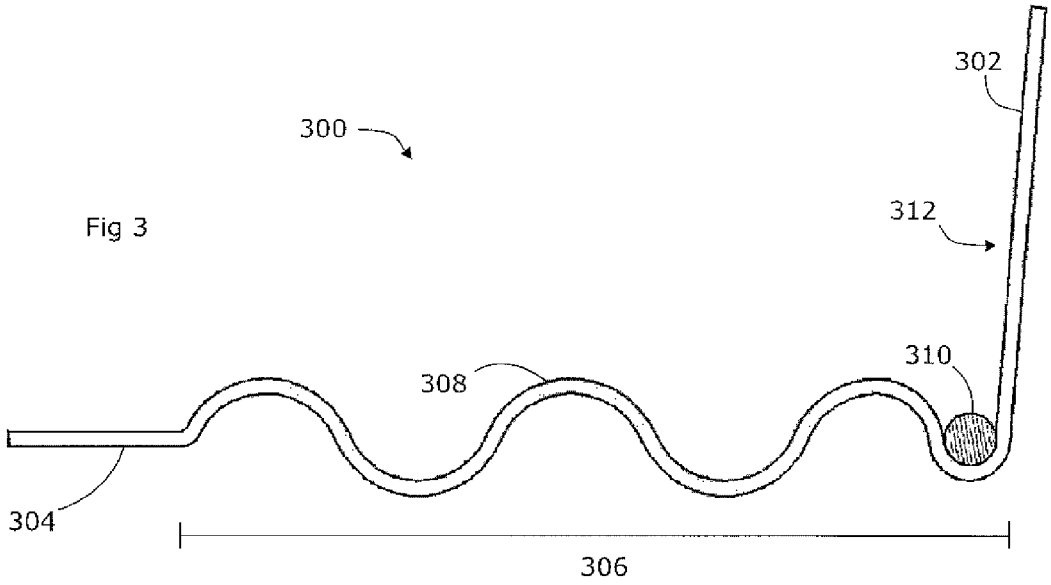
FIG. 3 shows a cross-section through part of a reinforced cupped suspension according to the present invention.

In order to make the stiffness-displacement curve and restoring force of a cupped suspension symmetrical in compression and expansion, according to embodiments of the present invention, we propose a suspension 300 as illustrated in FIG. 3. Note that for clarity only half the suspension is shown. In practice, the suspension runs circumferentially about the axis of the acoustic driver.

The suspension 300 is similar to those previously illustrated, except that it is in a different orientation. It has an inner edge 302 which is attachable to a moving part of the loudspeaker, and an outer edge 304 which is attachable to a fixed part of the loudspeaker. The region 306 between the inner and outer edges has a number of rolls 308 which allow the region to flex, expand and contract.

The flexible region 306 is at the same height as the outer edge 304, but the inner edge 302 is at a greater height (i.e. closer to the front of the loudspeaker). Such an orientation may occur, for example, where the outer edge 304 is mounted on the driver chassis, and the inner edge is connected to the diaphragm 12, or to ribs extending rearwardly from the diaphragm 12. A frusta-conical 'cup' region 312 protrudes up from the flexible region 306 to the inner edge 302.

The suspension further comprises a circumferential stiffening member 310, of relatively high elastic modulus material. That is, the Loop 310 is constructed from a material that provides a greater mechanical stiffness than the material used in the suspension 300 itself. Suitable examples include metal and plastic. However, lighter materials may in some cases be preferable as they will minimize the additional moving mass, and will help prevent the loop resonating on the suspension. The loop 310 is attached to the suspension by any suitable adhesive (not illustrated).

The loop 310 has a circular cross-section and, in the illustrated embodiment, sits on the inside of the cupped suspension, i.e. on the inside of the curve. In other embodiments the loop could be attached to the outside of the curve. In either orientation, the loop serves to limit the ability of the cup 312 to compress (i.e. to become more curved). Ordinarily, that is an easier direction for the cupped suspension to move in. Thus, the action of the loop 310 is to make the suspension stiffness more symmetrical about the rest position of the moving parts (e.g. the voice coil former 14 and the diaphragm 12). The suspension 300 according to embodiments of the present invention is equally difficult to compress as it is to extend (see FIG. 5).

Figure 4:
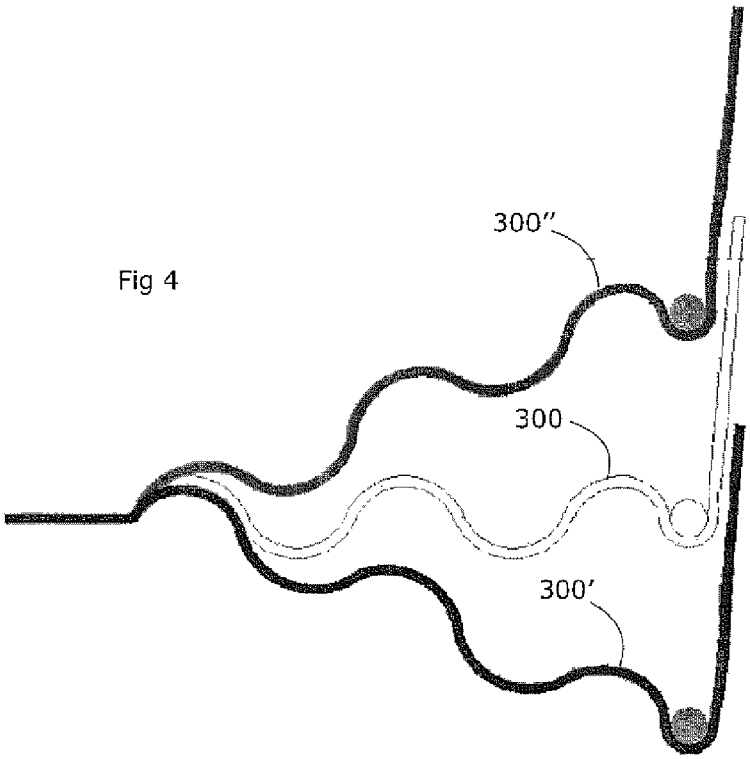
FIG. 4 shows the deformation under load of the suspension of FIG. 3.

FIG. 4 shows the suspension 300 undergoing expansion and compression as the diaphragm 12 moves up and down, respectively. In position 300", the inner edge 302 is moved forwards as the diaphragm moves forwards. The loop 310 has little effect on motion in this direction; it does not inhibit the suspension from expanding. In position 300', the diaphragm is moved backwards from its rest position, and the suspension is compressed. The loop 310 provides resistance to this motion, increasing the stiffness of the suspension in compression.

In some cases additional loops 310 may be used to further control bending. An example is a second loop attached part way up a deep cup.

Figure 5:
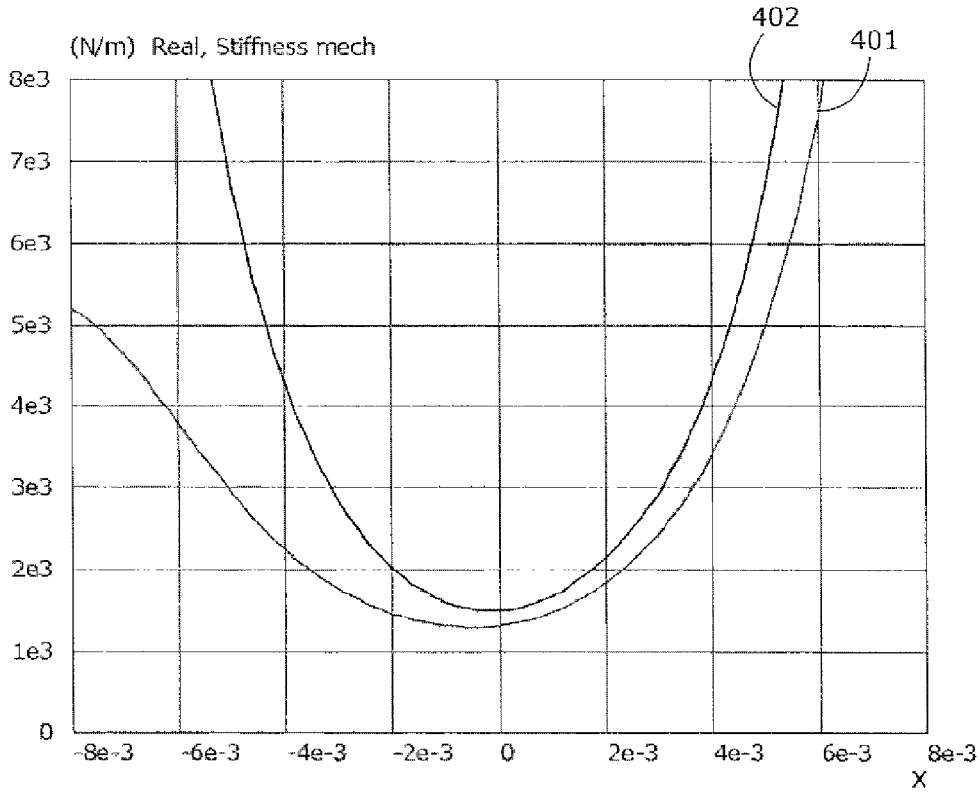
FIG. 5 shows the stiffness-displacement curve of the suspension of FIG. 3 compared to the same suspension without the reinforcing loop.

FIG. 5 is a graph showing the variation of stiffness in suspensions undergoing compression (negative displacement in the x direction) and expansion (positive displacement in the x direction).

Line 401 shows the stiffness curve of a conventional suspension, i.e. a cupped suspension without a stiffening loop. It can be seen that the curve is asymmetrical, with a lower stiffness at negative displacements than the corresponding positive displacement.

Line 402 shows the stiffness curve of a suspension according to embodiments of the present invention, i.e. a cupped suspension with a stiffening loop. The suspension as a whole is stiffer, due to the rigidity of the loop. However, the stiffness in compression is symmetrical with stiffness in expansion.

Figure 6:
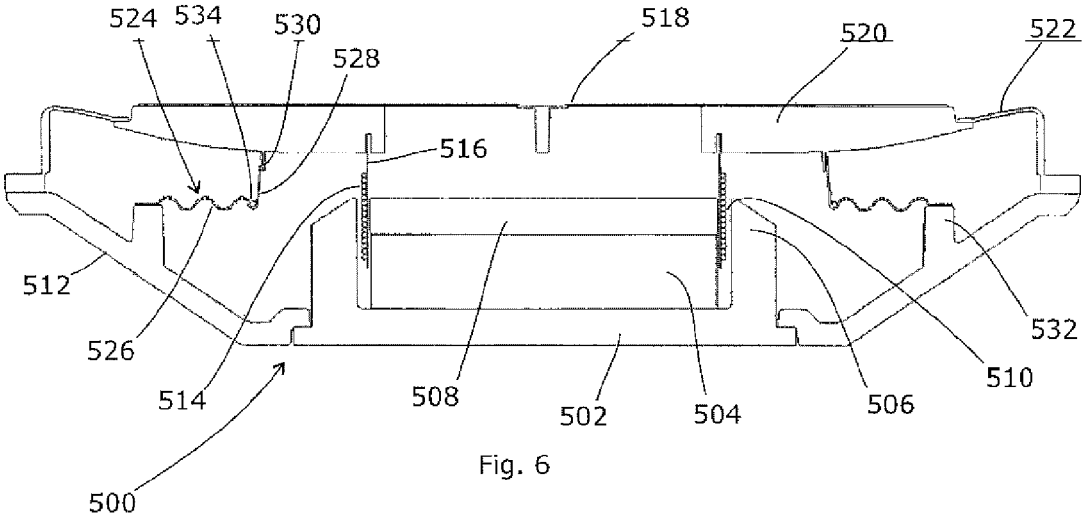
FIG. 6 shows a cross-section through the suspension of FIG. 3 in place within a loudspeaker.

FIG. 6 shows the suspension of FIG. 3 incorporated into a loudspeaker driver 500, designed as a low build height driver. A magnet assembly 502 carries a permanent magnet 504 and a central pole piece 508, and has a cylindrical outer pole piece 506 to define a magnetic field gap 510. A chassis member 512 sits concentrically around the magnet assembly 502 and provides supports for the other parts of the driver 500.

These include a voice coil 514 that is supported on a voice coil former 516 so as to lie at least partly within the magnetic field gap 510. The voice coil former 516 drives a diaphragm 518 which has a planar front surface in order to reduce the overall depth of the driver 500, as compared to a driver comprising a cone-shaped diaphragm. To provide the necessary rigidity, the diaphragm has stiffening ribs 520 on its rear face, and the voice coil former 516 is attached to these.

At its radially outermost extent, the diaphragm 518 is attached to a surround 522 which helps to centre the diaphragm 518 relative to the magnetic field gap 510, acts as an air seal, and provides a restoring force to return the diaphragm 518 to its rest position (illustrated). To increase the restoring force to an adequate level, a suspension 524 is also provided. Suspensions of this type typically comprise an annular band of material, attached on an inner radial edge to the diaphragm or voice coil former, and at an outer radial edge to a chassis component. The tensile properties of the band are controlled by forming a series of corrugations or rolls which tailor the restoring force exerted when the band is stretched to accommodate displacement of the diaphragm.

In this case, the suspension 524 cannot attach to the voice coil former 516 as there is insufficient room due to the low build height of the driver 500. Equally, if is it attached to the rear of the diaphragm 518, it cannot extend radially outwardly as it would then lie immediately behind the diaphragm 518 whose rearward movement would then be obstructed.

Instead, the suspension 524 comprises a corrugated band 526 as described above, from the radially inner part of which there is a portion 528 which protrudes forward to attach to suitable tabs 530 on the rear of the diaphragm 518. This allows the corrugated band 526 to extend outwardly, behind and spaced from the diaphragm 518, to a support 532 provided on the chassis member 512.

As described above, a reinforcement 534 is provided in order to control the dynamic behaviour of the suspension. This comprises a circumferential ring of a rigid polymeric material, or a lightweight metallic material such as an alloy of aluminium or the like, and is seated in the inner concave region defined at the join between the protruding portion 528 and the outer band 526. It can be affixed in this location by a suitable adhesive, or by weaving or other enclosure into the material of the suspension, or otherwise.

There is thus described a loudspeaker having a cupped suspension comprising a stiffening loop. By action of the loop, the suspension has a stiffness that can be symmetrical in expansion and compression.

It will of course be understood that many variations may be made to the above-described embodiment without departing from the scope of the present invention. For example, the specific orientations and relative locations of the various elements of the illustrated loudspeakers can be varied as required. The cup can be located on an inner region or an outer region of the suspension, and the suspension itself can be located outside the voice coil or within the interior of the voice coil, as required.

The invention claimed is:

1. A loudspeaker, comprising:

a driven body, responsive to electrical signals to undergo excursions from a rest position along an axis of motion, to project acoustic waves from a front of the loudspeaker; and a cupped suspension for providing a restoring force to the driven body towards the rest position, the suspension extending from an attachment point on the driven body to an attachment point on a fixed portion of the loudspeaker, wherein the attachment point on the fixed portion of the loudspeaker is displaced along the axis of motion relative to the attachment point on the driven body when the driven body is at rest;

the cupped suspension comprising;

a first concentric region of the suspension that is extendible to allow reciprocating axial movement of the driven body and has an edge attached to one of the attachment points, a second concentric region which extends transversely from the first region toward the other of the attachment points to form a frusto-conical cup, and a circumferential member affixed to the suspension at a location between the first and second concentric regions, the circumferential member being relatively stiff compared to the material forming the first and second concentric regions.

2. The loudspeaker as claimed in claim 1, wherein a radially inner edge of the suspension is coupled to the driven body, and a radially outer edge of the suspension is coupled to the fixed portion of the loudspeaker.

3. The loudspeaker as claimed in claim 1, wherein the circumferential member is attached to an inner concave region of the suspension.

4. The loudspeaker as claimed in claim 1, wherein the circumferential member is attached to an outer convex region of the suspension.

5. The loudspeaker as claimed in claim 1, wherein the first concentric region comprises one or more circumferential rolls of material.

6. The loudspeaker as claimed in claim 1, wherein the circumferential member has a circular cross section.

7. A loudspeaker as claimed in claim 1, wherein the circumferential member is attached to the suspension close to an inner edge.

8. The loudspeaker as claimed in claim 1, wherein the suspension comprises a further relatively stiff circumferential member.

9. The loudspeaker as claimed in claim 1, wherein the driven body comprises a voice coil former, and wherein an edge of the suspension is connected to the voice coil former.

10. The loudspeaker as claimed in claim 9 wherein an inner edge of the suspension is connected to the voice coil former.

11. The loudspeaker as claimed in claim 1, wherein the driven body comprises a diaphragm, and wherein an edge of the suspension is connected to the diaphragm.

12. The loudspeaker as claimed in claim 11 wherein an inner edge of the suspension is connected to the diaphragm.

13. The loudspeaker as claimed in claim 1, wherein the driven body comprises a ribbed diaphragm, and wherein an edge of the suspension is connected to one or more ribs extending rearwards from the diaphragm.

14. The loudspeaker as claimed in claim 13 wherein an inner edge of the suspension is connected to said one or more ribs extending rearwards from the diaphragm.

15. The loudspeaker as claimed in claim 1, wherein the relatively stiff circumferential member serves to increase the restoring force provided by the suspension in one direction of displacement of the driven body.

16. A loudspeaker, comprising:

a driven body, responsive to electrical signals to undergo excursions from a rest position along an axis of motion, to project acoustic waves from a front of the loudspeaker, wherein the driven body comprises a voice coil former, and wherein an edge of the suspension is connected to the voice coil former; and a suspension for providing a restoring force to the driven body towards the rest position, the suspension extending from an attachment point on the driven body to an attachment point on a fixed portion of the loudspeaker, wherein the attachment point on the fixed portion of the loudspeaker is displaced along the axis of motion relative to the attachment point on the driven body when the driven body is at rest;

the suspension comprising;

a first concentric region of the suspension that is extendible to allow reciprocating axial movement of the driven body, a second concentric region which extends transversely from the first region toward one of the attachment points, and a circumferential member affixed to the suspension at a location between the first and second concentric regions, the circumferential member being relatively stiff compared to the material forming the first and second concentric regions.

17. The loudspeaker as claimed in claim 16, wherein a radially inner edge of the suspension is coupled to the driven body, and a radially outer edge of the suspension is coupled to the fixed portion of the loudspeaker.

18. The loudspeaker as claimed in claim 16, wherein the circumferential member is attached to an inner concave region of the suspension.

19. The loudspeaker as claimed in claim 16, wherein the circumferential member is attached to an outer convex region of the suspension.

20. The loudspeaker as claimed in claim 16, wherein the first concentric region comprises one or more circumferential rolls of material.

* * * * *